US006296057B2

(12) United States Patent
Thiercelin

(10) Patent No.: US 6,296,057 B2
(45) **Date of Patent: *Oct. 2, 2001**

(54) METHOD OF MAINTAINING THE INTEGRITY OF A SEAL-FORMING SHEATH, IN PARTICULAR A WELL CEMENTING SHEATH

(75) Inventor: Marc J Thiercelin, D'Auray (FR)

(73) Assignee: Schlumberger Technology Corporation, Sugar Land, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,131

(22) Filed: Sep. 23, 1998

(30) Foreign Application Priority Data

Sep. 23, 1997 (FR) ..... 97 11821

(51) Int. Cl.[7] ..... E21B 33/14; E21B 47/00
(52) U.S. Cl. ..... 166/285; 164/250.14; 73/152.57
(58) Field of Search ..... 166/250.14, 285; 73/152.57

(56) References Cited

U.S. PATENT DOCUMENTS 3,927,163 * 12/1975 Gabriel et al. ..... 264/71
4,440,226 * 4/1984 Suman, Jr. ..... 166/250.14
5,020,594 * 6/1991 Gill ..... 166/285
5,348,093 * 9/1994 Wood et al. ..... 166/250.14
5,355,951 * 10/1994 Allen et al. ..... 166/253.1

OTHER PUBLICATIONS

French Search Report entitled "Rapport de Recherche Preliminaire", dated Juin. 26, 1998.
Thiercelin et al., "Cement Design Based on Cement mechanical Response", 1997 SPE Annual Conference and Exhibition, Oct 5–8, 1997, San Antonio, Texas, pp. 337–348, XP–002068174.

* cited by examiner

*Primary Examiner*—David Bagnell
*Assistant Examiner*—Jennifer R. Dougherty
(74) *Attorney, Agent, or Firm*—Robin C. Nava; Thomas O. Mitchell

(57) ABSTRACT

A method of maintaining the integrity of a sheath, in particular a cementing sheath in a well consists in calculating or estimating variations in well pressure and/or in well temperature and/or in the variations in in-situ stresses, which may occur during the lifetime of the well, evaluating the stresses in the sheath as a function of the above variations, determining the nature of the stress likely to be first in causing deterioration of the sheath, and the risk thereof, and evaluating the influence of the elastic properties of the sheath, of the rock and/or of the casing on this stress, in order to select a sheath which is capable of attenuating this deterioration. The method is of particular application to oil, water, gas, and geothermal wells.

13 Claims, 4 Drawing Sheets

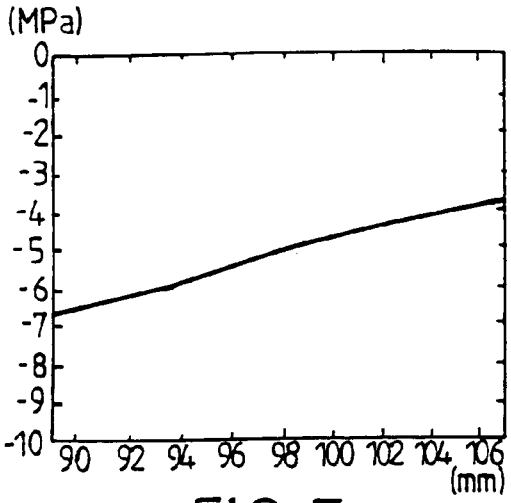
FIG.5
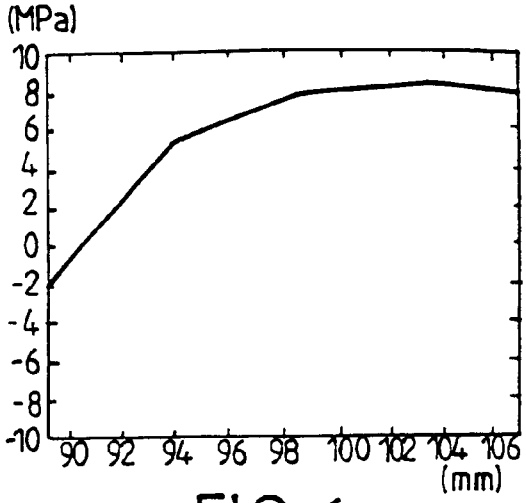
FIG.6
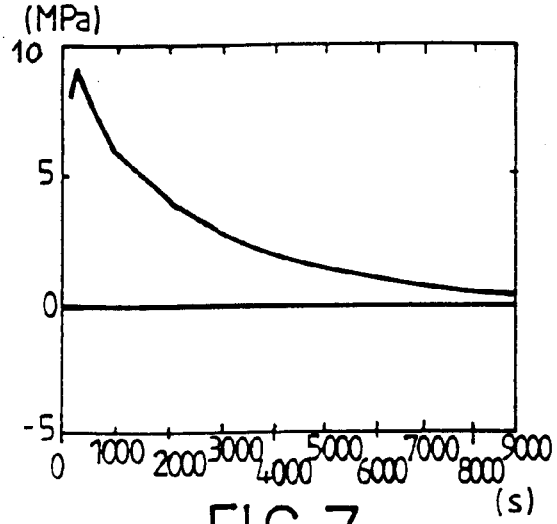
FIG.7
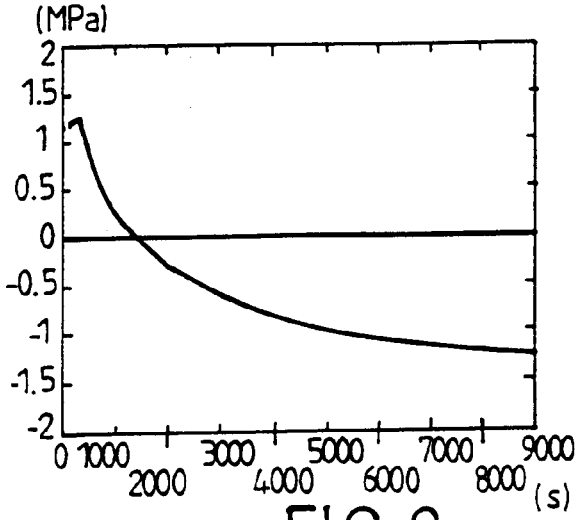
FIG.8
FIG.9
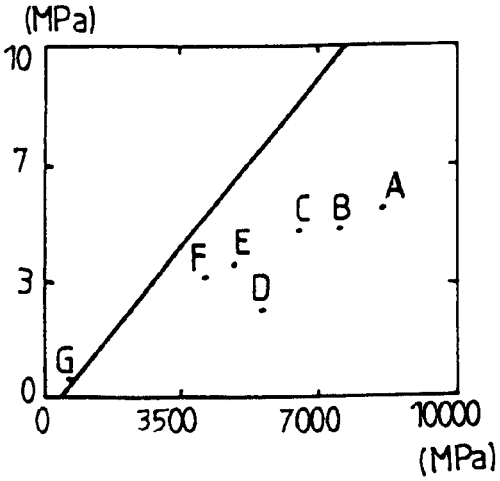

METHOD OF MAINTAINING THE INTEGRITY OF A SEAL-FORMING SHEATH, IN PARTICULAR A WELL CEMENTING SHEATH

BACKGROUND OF THE INVENTION

1. Field of the Invention

The present invention relates to a method for maintaining the integrity of a seal-forming sheath, in particular a cementing sheath, positioned around a metal casing for an oil, gas, water, geothermal or analogous well.

2. Description of the Related Art

An oil, water or gas field is usually exploited via a well into which a metal casing has been inserted and held in place by a cement sheath to fill the space or annulus between the casing and the borehole. The cementing operation, i.e. putting the sheath into position consists in injecting a cement slurry into the casing to cause the drilling mud in particular to rise up and be evacuated via the annulus which is then gradually filled with the slurry. After the slurry has set and hardened, a cement sheath is obtained which prevents any fluid communication between the various formations through which the well passes, and which acts as a support for the metal casing.

Well-cementing is an operation that is very difficult because it requires several parameters to be taken into consideration and kept under control. For example, a slurry with too high a density can cause the rock to fracture, while a slurry with too low a density can cause external fluids to intrude. While slurry density is a parameter which is relatively easy to control, this is not true of its rheological properties. Such problems, which are inherent to any well-cementing operation, are well known to the skilled person, and solutions generally consist in adding various additives to the slurry, the selection of which is not always clear and varies from one well to another.

However, even in a situation where this cementing operation is carried out under good conditions to obtain a sheath which seals and supports once the slurry has set and hardened, it is not long before that sheath is subjected to mechanical and/or thermal stresses which can cause the sheath to deteriorate, and this can culminate in well operating conditions being put into doubt.

Such problems linked to sheath deterioration over the lifetime of the well are not novel in themselves and are well known to the skilled person, but up until now no practical approach has been made to attempt to provide a solution to such problems.

SUMMARY OF THE INVENTION

A principal aim of the invention is to analyse more precisely the mechanical and/or thermal stresses to which the sheath may be subjected during the lifetime of the well, the effects of these stresses and the influence of mechanical and/or physical parameters of the cement, the casing and/or the rock on these stresses, to obtain a solution which can clearly answer these problems of sheath deterioration.

To this end, the invention provides a method which is characterized in that it consists in:

calculating or estimating pressure and/or temperature variations in the well and/or variations in in-situ stresses, which can occur during the lifetime of the well;

for a given sheath, evaluating the various stresses which will be applied to that sheath, in particular as a function of the variations defined above and taking into account the geometrical characteristics of the well and of the casing, and also the mechanical properties of the rock;

from the above evaluation of the various stresses, determining the nature of the stress which is likely to cause sheath deterioration in the first instance;

evaluating the influence of the mechanical and/or physical properties of the sheath, the rock and/or the casing on the above-defined stress;

selecting a sheath with mechanical and/or physical properties which are likely to attenuate the effects of the above-defined stress; and positioning the sheath as selected in this way around the well casing.

In general, analysis of the data obtained by modelling and which has served as a basis for the definition of the method of the invention has served to identify three main types of deterioration which can damage the sheath, namely cracking due to failure in tension or in shear, or detachment at the interfaces with the casing and the sheath.

An analysis of the influence of the mechanical and/or physical properties of the sheath, of the casing and/or of the rock on these types of deterioration has enabled the method of the invention to be refined to attenuate the risk of these types of deterioration occurring.

Thus, in accordance with two further characteristics of the invention, the method includes:

taking the elastic properties of the sheath into account, and selecting a sheath for which the ratio between its tensile strength and its Young's modulus is as high as possible, and/or also taking the elastic properties of the rock into account, and selecting a sheath with a Young's modulus which is lower than the Young's modulus of the rock.

With such provisions, the method can attenuate the risk of a crack occurring in the sheath, in particular as a result of an increase in well pressure and/or temperature.

If well pressure increases, the method can also include increasing the thickness of the casing to limit its deformation.

If well temperature increases, the method can also include controlling the increase in temperature to attenuate the effects on the sheath.

In a further feature of the invention, the method also includes placing the sheath in compression while it is being positioned around the well casing.

With such an arrangement, the method can also attenuate the risk of sheath detachment occurring, in particular following a reduction in pressure at the sheath-rock interface.

In general, the experimental data as obtained numerically and/or mathematically on studying the risks of the cement sheath failing under tension or shear and the risk of sheath detachment at the casing-sheath and sheath-rock interfaces as a result of the mechanical and thermal stresses to which the sheath will be subjected during the lifetime of the well have led to the discovery that these risks can all be substantially attenuated, in particularly by adjusting the elastic properties of the cement.

Thus this data has led lo the development of a method which can be used to define the properties required for the sheath, in particular its elastic properties, before proceeding to position it around a well casing.

Cements for cementing sheaths which have the required properties after setting and hardening of the cement slurry are currently selected essentially by adjusting the rheological properties of the slurry. This means defining numerous slurry compositions.

Under such conditions, the method of the invention can also be used as a tool to test slurry compositions and determine, for a given well, their ability to withstand the strains of various mechanical and/or thermal stress systems to which the cementing sheath will be subjected during the lifetime of the well.

An important advantage of the invention is that carrying out the method does not require the well to be equipped with additional technical means to protect the cement sheath.

BRIEF DESCRIPTION OF THE DRAWINGS

Further characteristics, advantages and details of the method of the invention become apparent from the description below which is made with reference to the accompanying drawings, given by way of example for a cementing sheath and in which:

FIGS. 5 to 9 are graphs of the stresses to which the cement sheath is subjected during an increase in the temperature in the well and the influence of the elastic properties of the cement on the tensile strength required for the cement to avoid failure under tension in the sheath;

DETAILED DESCRIPTION OF THE INVENTION

Figure 1:
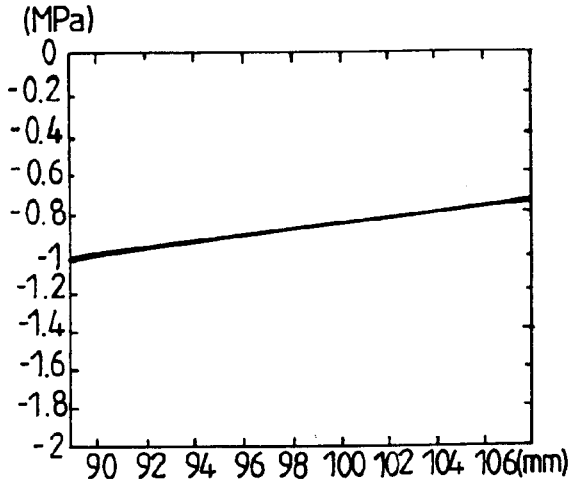
FIGS. 1 to 4 are graphs of the stresses to which the cement sheath is subjected during an increase in well pressure, and the influence of the elastic properties of the cement and rock on the tensile strength required for the cement to avoid failure under tension in the sheath.

In general, the cement sheath of a well is subjected to mechanical and/or thermal stresses over time which can be resolved into tangential, axial and radial stresses which are in extension or compression.

The assumption made in the study which was carried out on these stresses was that the axial stresses are practically zero, and essentially only the tangential and radial stresses in a plane perpendicular to the well axis were considered.

As indicated in the preamble, an analysis of these stresses and the data recorded during the study have enabled three principal types of deterioration to be determined which can damage the integrity of the cement sheath during the lifetime of the well.

I. The first type of deterioration is a risk of tension failure of the sheath with the appearance and propagation of radial cracks in the cement which can result in particular from an increase in well pressure or temperature.

This type of tension failure of the sheath is essentially caused by the action of tangential stresses which are in extension, while the radial stresses are in compression. Since the tensile strength of a cement is always substantially lower than its compressive strength, the tangential stresses will be the first to cause possible cracking of the cement.

A. An increase in well pressure can occur when drilling a new section of the well, during leakage tests, during casing shoe tests, when perforating the casing and when stimulating the formation or the reservoir by hydraulic fracturing. Such a pressure increase can be as high as 30 MPa to 40 MPa.

With reference to FIGS. 1 to 4 based on the study data, the stress conditions in the cement are examined below for an increase of the order of 6.90 MPa in well pressure.

Consider a well with the following characteristics:

borehole diameter: 215.9 mm;

external diameter of casing: 117.8 mm;

internal diameter of casing: 152.5 mm;

gross casing weight: 52 kg/m;

Young's modulus of casing 200 GPa, of cement 5 GPa, and of rock 10 GPa.

The tests were carried out using a slurry formulated with Holnam H C4474 cement with the following composition (gal/sk=3.78 liters (l) per 94 pound (lb) (42.6 kg) sack of cement, namely 1 gal/sk=0.088 l of additive per kg of cement; 1 ppg=0.1198 g/cm$^3$. The quantity of water is given as the percent by weight with respect to the weight of cement.

| Latex D600 (gal/sk) | Stabiliser D135 (gal/sk) | Dispersing agent D80 (gal/sk) | Retarding agent D801 (gal/sk) | Anti-foam D144 (gal/sk) | Water (%) | Density (ppg) | Porosity |
|---|---|---|---|---|---|---|---|
| 0 | 0 | 0.060 | 0.070 | 0.03 | 37.78 | 16.4 | 55.41 |
| 1 | 0.1 | 0.03 | 0.02 | 0.03 | 28.87 | 16.4 | 49.24 |
| 2 | 0.2 | 0.045 | 0.02 | 0.03 | 19.3 | 16.4 | 43.23 |
| 3 | 0.3 | 0.075 | 0.015 | 0.03 | 9.67 | 16.4 | 37.30 |
| 4 | 0.4 | 0.15 | 0 | 0.03 | 1.45 | 16.2 | 33.19 |

D600, D135, D80, D801 and D144 are additives sold by Schlumberger Dowell.

The stress conditions in the cement were calculated assuming the cement, the casing steel, and the rock to be thermoelastic or poroelastic materials and the cement/rock and cement/casing interfaces to be complete or non-existent. Further, once setting had occurred, internal stresses in the cement were assumed to be absent.

The risk of failure of the cement could be analysed by means of the Mohr-Coulomb criterion which states that the stress $\tau$ tending to cause failure is limited by the cohesion of the material and by a constant which is analogous to the internal coefficient of friction multiplied by the normal stress $\sigma_n$ exerted in a plane perpendicular to the plane of failure.

Figure 2:
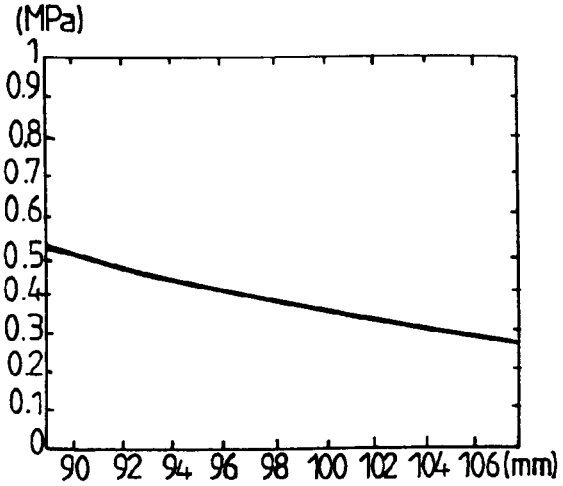

FIGS. 1 and 2 show the radial stress conditions (FIG. 1) and the tangential stress conditions (FIG. 2) in the sheath as a function of the distance from the well axis, i.e., between the casing-sheath interface and the sheath-rock interface.

Examination of these two FIGS. 1 and 2 shows:

that the radial stresses are in compression;

that the tangential stresses are in extension; and that the tangential stress in extension is at its highest at the casing-sheath interface.

Thus it is the tangential stress in extension as applied at the casing-sheath interface that makes it possible to determine the tensile strength which the cement must possess in order to avoid the appearance and propagation of radial cracks.

The influence of the elastic properties of the sheath and of the rock on the tensile strength required for the cement are examined below.

Figure 3:
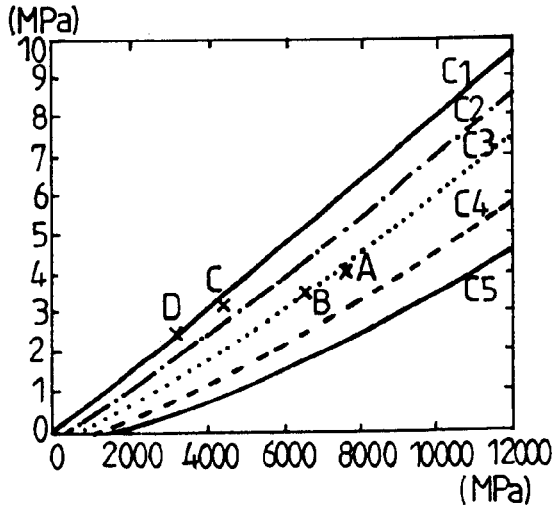

FIG. 3 shows the variations in the values of this tensile strength as a function of the Young's modulus of the cement for various values of the Young's modulus of the rock. Curves C1 to C5 correspond to values of rock Young's modulus which are of the order of 1 GPa, 5 GPa, 10 GPa, 20 GPa and 30 GPa respectively.

An examination of each of curves C1–C5 shows that the tensile strength required for the cement increases with the value of its Young's modulus.

Now, although the study data also shows that the tensile strength of the cement increases with the value of its Young's modulus, it must not be concluded that a cement with a high tensile strength will be more resistant than a more flexible cement with a lower tensile strength.

In fact, curves C1–C5 show that the tensile strength required for the cement diminishes with the Young's modulus of the rock, i.e., when the cement is more flexible than the rock, the rock acts as the mechanical support.

As an example, a cement obtained from a slurry with the composition given above has a Young's modulus of the order of 7800 MPa, and a tensile strength of the order of 4 MPa, shown at point A in FIG. 3. By adding an additive such as a styrene-butadiene type latex to this cement slurry in the following proportions: 2 gps (point B), 3 gps (point C) and 4 gps (point D), the cement is rendered more flexible and its Young's modulus and tensile strength are reduced.

Considering a rock with a Young's modulus of 10 GPa (curve C3), the tensile strength of cements A and B will be insufficient to avoid tension failure of the sheath on increasing the well pressure by a value of the order of 6.90 MPa. In contrast, the tensile strength of cements C and D will be sufficient to avoid tension failure since points C and D are above curve C3.

Figure 4:
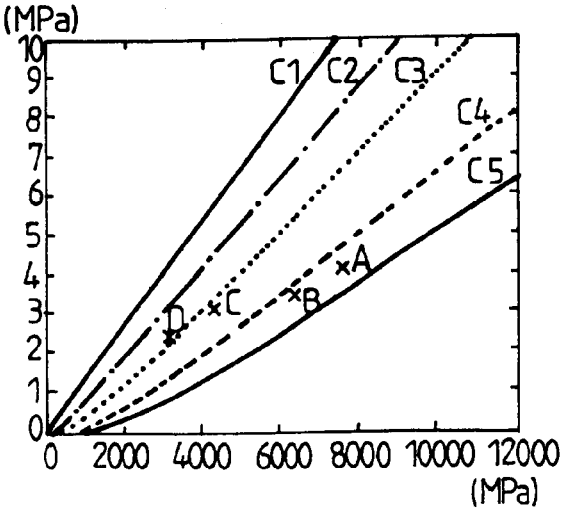

FIG. 4 is analogous to FIG. 3 but for a casing of lower weight. It can be seen that the slopes of curves C1–C5 in FIG. 4 are steeper than the corresponding curves in FIG. 3, i.e., the tensile strengths required for the cement increase because the casing undergoes greater deformation under the action of an increase in well pressure.

In general, the data from the studies also shows that the tensile strengths required for the cement vary substantially linearly with the increase in well pressure, the value of these tensile strengths being multiplied by two when the pressure increase doubles.

An examination of the preceding figures also shows that the tangential stresses become more and more compressive when the Young's modulus of the cement is very low and the Young's modulus of the rock is very high. Under these particular conditions, the risk of failure of the sheath under tension is substantially reduced.

The study data has demonstrated that the risk of failure of the cement sheath under tension as a result of an increase in well pressure is attenuated:

- if the ratio between the tensile strength of the cement and its Young's modulus is as high as possible; and/or
- if the Young's modulus of the cement is lower than the Young's modulus of the rock; and/or
- if the thickness of the casing is increased.

B. An increase in well temperature can occur, in particular during production of formation fluids, in which case it can reach a value of about 100° C., and during injection of steam into a formation to stimulate production, in which case it can reach a value of about 300° C.

The study was carried out considering the following parameters:

| | casing | cement | rock |
|---|---|---|---|
| solid density (kg/m$^3$) | 8000 | 1900 | 2100 |
| specific heat (5 Jkg$^{-1}$K$^{-1}$) | 500 | 2100 | 1900 |
| thermal expansion coefficient (K$^{-1}$) | $1.3 \times 10^{-5}$ | $1.3 \times 10^{-5}$ | $1.3 \times 10^{-5}$ |
| thermal conductivity (W/mK) | 15 | 1 | 1 |

The stress conditions in a cement with the above characteristics are examined below using FIGS. 5 to 9 for an increase of 55.6° C. in the well temperature.

FIGS. 5 and 6 show the radial stress conditions (FIG. 5) and the tangential stress conditions (FIG. 6) in the sheath as a function of distance from the well axis, measurements being made 100 seconds after increasing the well temperature.

These two figures show:

- that the radial stresses are in compression (FIG. 5);
- that the tangential stresses are in compression towards the casing-sheath interface and in extension towards the sheath-rock interface (FIG. 6); and
- that the tangential stress in extension is highest at the sheath-rock interface.

Thus it is the tangential stress in extension located in the majority of cases at the sheath-rock interface that determines the value of the tensile strength required for the cement to avoid the appearance and propagation of radial cracks.

The influence of the elastic properties of the sheath on the tensile strength required for the cement are examined below.

FIGS. 7 and 8 show the variations in the value of this tangential stress in tension at the sheath-rock interface as a function of the time after the temperature increase. The curves in FIGS. 7 and 8 correspond to Young's modulus values for the cement of 10 GPa and 5 GPa respectively.

An examination of these two FIGS. 7 and 8 shows that a cement with a low Young's modulus is more resistant than a cement with a high Young's modulus. The tangential stress reaches a value of the order of 8.97 MPa in FIG. 7 for a Young's modulus of the rock of the order of 10 GPa, while this tangential stress only reaches a value of the order of 1.3 MPa in FIG. 8 for a Young's modulus of the order of 5 GPa.

These results are similar to those observed when studying an increase in well pressure, namely that the rock constitutes a mechanical support for the sheath when the Young's modulus of the rock is higher than the Young's modulus of the cement.

FIG. 9 shows the variations in tensile strength required for the cement to be able to resist a tension failure as a function of the Young's modulus of the cement and for an increase of the order of 111.2° C. in the temperature for a given well, at a given depth and for a given type of rock. FIG. 9 shows seven points A to G which correspond to cements of increasing flexibility. An examination of FIG. 9 shows that cement G which is the most flexible is the only cement capable of avoiding tension failure of the sheath under the conditions envisaged above.

The data demonstrates that the risk of tension failure of the cement sheath as a result of an increase in well temperature is attenuated:

- if the ratio between the tensile strength of the cement and its Young's modulus is as high as possible; and/or
- if the Young's modulus of the cement is lower than the Young's modulus of the rock.

Further, this risk of tension failure of the sheath can be greatly reduced if the temperature rise can be controlled to reduce the effects of temperature on the sheath, which is possible when injecting steam into the formation to increase its production.

In general, the tangential stresses in extension have been shown to be the first to deteriorate the sheath during an increase in well pressure or temperature. However, this deterioration in the sheath can be followed by further deterioration caused by the action of the radial stresses which are in compression, in particular in the case where the pressure increase in the well persists.

II. The second type of deterioration is a risk of shear failure of the sheath which can occur as a result of creep or compacting of the formation, or a drop in pore pressure in the formation which may result from overall in-situ stress conditions becoming less compressive.

In general, all of these phenomena result in particular in an increase in the pressure, i.e., the radial stress at the sheath-rock interface.

The stress conditions in the cement for an increase of the order of 6.90 MPa in the pressure at the sheath-rock interface are examined below by considering a well with the geometrical characteristics defined above, and referring to FIGS. 10 to 13 which are drawn up from the study data.

Figure 10:
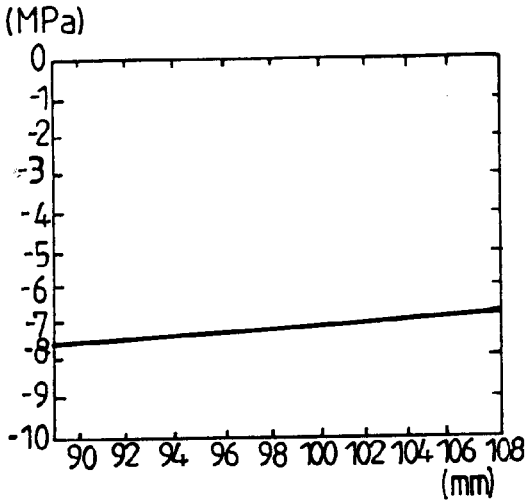
FIGS. 10 to 13 are graphs of the stresses to which the cement sheath is subjected during an increase in the pressure at the sheath-rock interface, and the influence of the elastic properties of the cement on these stresses.
Figure 11:
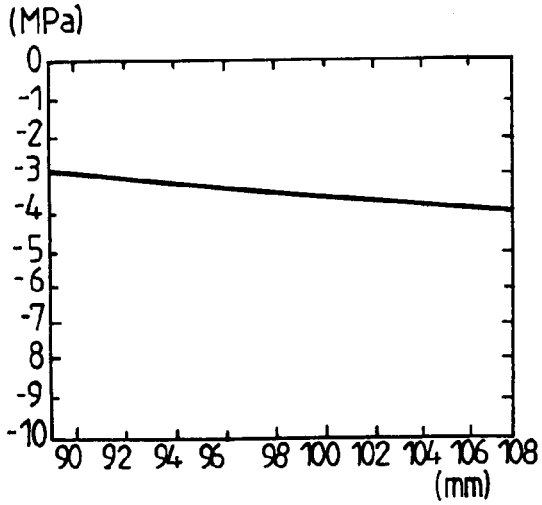

FIGS. 10 and 11 show the radial stress conditions (FIG. 10) and the tangential stress conditions (FIG. 11) in the sheath as a function of the distance from the well axis, i.e., between the casing-sheath interface and the sheath-rock interface.

An examination of these two FIGS. 10 and 11 shows:

- that the radial and tangential stresses are in compression; and
- that the maximum value for the tangential stresses and the minimum value for the radial stresses are at the casing-sheath interface, the sheath having its highest probability of shear failure at this interface.

The influence of the elastic properties of the sheath on the compressive strength required for the cement is examined below.

Figure 12:
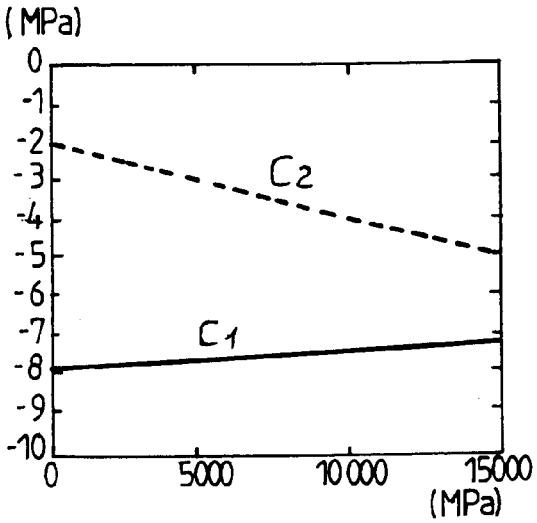

FIG. 12 shows the variations in the radial stresses (curve C1) and tangential stresses (curve C2) in the sheath as a function of the Young's modulus of the cement, at the casing-sheath interface.

An examination of FIG. 12 shows:

- that the value of the radial stresses reduces with the Young's modulus of the cement, these stresses becoming more and more compressive;
- that the value of the tangential stresses increases with the Young's modulus of the cement, these stresses becoming less and less compressive; and
- that as a result, the sheath acts as a mechanical support for the casing by reducing the value of the stresses which are applied thereto.

For a well of larger diameter, i.e., if the thickness of the sheath is increased, the data shows that that has no notable effect on the radial stresses which are exerted at the casing-sheath interface.

Figure 13:
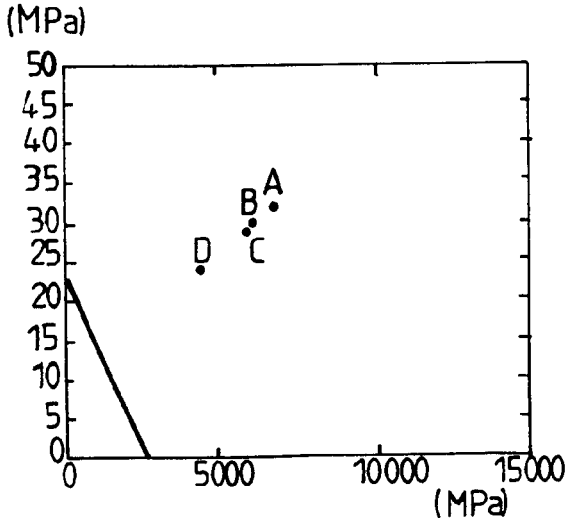

FIG. 13 shows the variations in the compressive strength required for the cement to avoid shear failure, as a function of the Young's modulus of the cement and for an increase of the order of 70 MPa in the pressure at the sheath-rock interface. The failure criterion used was the Mohr-Coulomb type criterion, knowing that cements have an internal angle of friction of the order of 30°.

As an example, a cement obtained from a slurry with the composition defined above has a Young's modulus of the order of 7800 MPa and a compressive strength of the order of 35 MPa, which is shown as point A in FIG. 13. By adding an additive such as a styrene-butadiene type latex to the cement slurry in the following proportions: 2 gps (point B), 3 gps (point C) and 4 gps (point D), the cement was rendered more flexible and its Young's modulus and compressive strength were reduced.

Thus cements A, B, C and D have compressive strength which is largely sufficient to avoid shear failure of the sheath under the conditions defined above.

In general, a rigid cement will resist a compressive stress better, but a cement with a ratio between its compressive strength and its Young's modulus which is as high as possible will also be satisfactory.

III. The third type of deterioration is a risk of detachment of the sheath at its interface with the casing and/or the rock.

Such detachment can result from:

- a reduction in the pressure inside the well when the density of the drilling mud used to drill a new section of the well is reduced or when the pore pressure in the reservoir increases; or
- a reduction in the temperature in the well or in the pressure at the sheath-rock interface during injection of a cold fluid into the formation during hydraulic fracturing, for example.

In general, the tangential stresses become compressive, while the radial stresses are more and more in extension and can cause the sheath to become detached.

A reduction in well pressure can be treated as the application of a radial stress in extension at the casing-sheath interface. Under these conditions, the radial and tangential stress conditions are generally similar to those shown in FIGS. 1 and 2 for an increase in well pressure, but with the opposite sign.

In other words:

- the radial stresses are in extension with a maximum value at the casing-sheath interface, which can cause the sheath to become detached at this location; and
- the radial stresses are also in extension at the sheath-rock interface, which can also cause the sheath to become detached at this location.

Detachment of the sheath can occur at one and/or the other interface depending on the degree of adhesion of the cement to these interfaces.

The influence of the elastic properties of the sheath and the rock on the tensile strength required to avoid detachment of the sheath when the well pressure is reduced are examined below.

Figure 14:
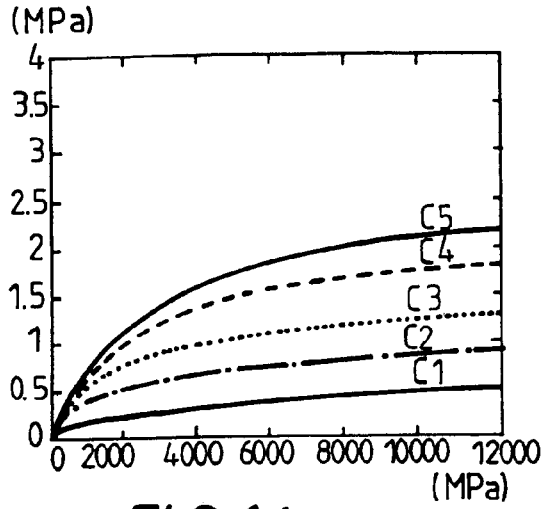
FIGS. 14 to 16 show graphs of the stresses to which the cement sheath is subjected during a reduction in the well pressure, and the influence of the elastic properties of the cement on these stresses.

FIG. 14 shows the variations in tensile strength required for the cement at the casing-sheath interface to prevent detachment of the sheath, as a function of the Young's modulus of the cement and for various values of the Young's modulus of the rock. Curves C1 to C5 were produced which correspond respectively to values of 1 GPa, 5 GPa, 10 GPa, 20 GPa and 30 GPa for the Young's modulus of the rock, and for a reduction of the order of 6.9 MPa in the well pressure.

Examination of FIG. 14 shows that, in contrast to FIGS. 3 and 4 regarding an increase in well pressure:

- that the cement tensile strength required to avoid detachment of the sheath increases with the Young's modulus of the rock, since the presence of hard rock prevents the sheath from deforming; and
- that the cement tensile strength required to prevent the sheath from becoming detached also increases with the Young's modulus of the cement, but this increase is smaller for high values for the Young's modulus of the cement.

It could be concluded that it is desirable to have a sheath the cement of which has a high Young's modulus but in practice the stresses in extension are difficult to evaluate at the two interfaces of the sheath. In effect, the adhesion of the cement can vary depending on the presence or absence of a cake between the cement and the rock. This cake can be a film of drilling mud which forms during the well cementing operation when the drilling mud is evacuated via the annulus.

The study has demonstrated that to avoid detachment of the sheath at the interfaces, i.e., the appearance of a micro-annulus, the best solution is to place the cement under compression while it is being positioned around the casing.

Thus the cement will store a certain amount of elastic energy which it can then release on expanding during contraction of the casing caused by a reduction in well pressure. However, a micro-annulus may be created at one of the interfaces if the precaution of controlling the degree of contraction of the casing and the degree of expansion of the cement is not taken.

A cement under compression can be produced by using either a cement foam, i.e., a cement into which a gas such as nitrogen has been injected, or a cement which expands during setting to stress it.

Figure 15:
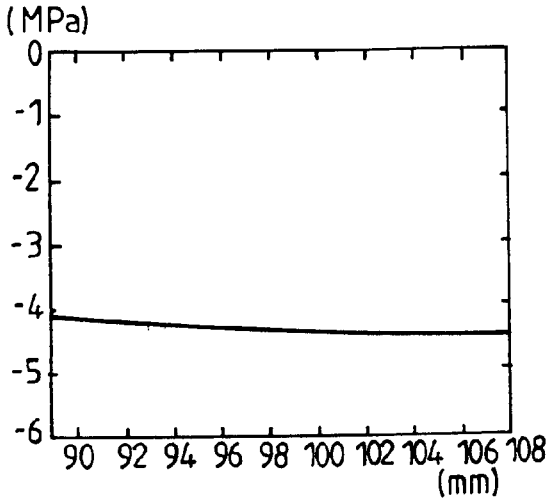

FIG. 15 shows the radial stress conditions in cement as a function of the distance from the well axis, once the cement has expanded by an amount of the order of 0.5% for a Young's modulus of the order of 1 GPa and a rock Young's modulus of the order of 10 GPa.

An examination of FIG. 15 shows that the radial stresses are in compression from the casing-sheath to the sheath-rock interface, indicating that the cement is properly in compression. The study has also shown that an increase in the Young's modulus of the cement increases the radial stresses at the casing-sheath interface without substantially modifying the stresses at the sheath-rock interface.

Figure 16:
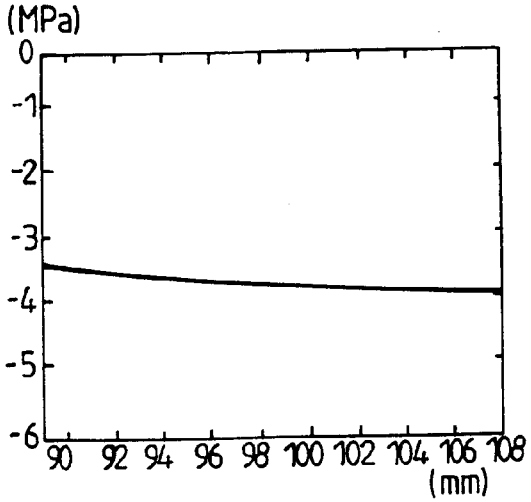

FIG. 16 shows the radial stresses of FIG. 15 after a reduction in well pressure of the order of 6.90 MPa. An examination of FIG. 16 shows that these radial stresses are always in compression, i.e., cement adhesion is maintained at both interfaces. In other words, with a cement under compression, a comparative examination of FIGS. 14 and 16 shows that the radial stresses are in compression and not in extension.

However, the study has also shown that for a circularly shaped well, expansion of the cement can lead to a risk of detachment of the casing at the casing-sheath interface, in particular if the cement is more rigid than the rock. In order to reduce the risk of detachment and encourage expansion of the cement towards the casing, it is desirable to select a value for the Young's modulus of the cement which is lower than the Young's modulus of the rock. It is also desirable to calculate the amount of expansion of the cement sheath as a function of the variation in load. Too little expansion would not be sufficient to avoid detachment of the sheath, while too much expansion would damage the sheath.

Thus the study has led to the conclusion that a risk of detachment of the sheath can be avoided:

- if the ratio between the tensile strength of the sheath and its Young's modulus is as high as possible; and/or
- if the Young's modulus of the cement is lower than the Young's modulus of the rock; and/or
- if the cement expands during setting to place it in compression.

The same overall conclusion can be drawn as that drawn by the study regarding avoiding the risk of sheath cracking.

In general, the study has also demonstrated that the conditions for reducing the risk of detachment of the sheath as a result of a reduction in well pressure is overall the same as in the case of an increase in well pressure with the additional condition of keeping the cement in compression with this pressure drop.

The risk of sheath detachment can occur as a result of a variation in the in-situ stresses, in particular when the pore pressure in the reservoir increases. These stresses can increase by an amount of the order of 30 MPa. In other words, the in-situ stresses become more compressive, but the effective stresses in the cement become less compressive. The effective stress is the total stress minus a function of the pore pressure. This effective stress is the stress which controls deformation of the solid material.

In general, the data shows that the radial and tangential stresses are in extension but the radial stresses are in extension to a greater extent than the tangential stresses and the highest value of these radial stresses is at the casing-sheath interface.

Overall, the conditions are thus similar to those corresponding to a reduction in well pressure, i.e., with a risk of sheath detachment which is a function of the adhesion of the cement to the casing and to the rock.

Finally, the data shows that the influence of the pore pressure in the formation on the stresses in the sheath is globally similar to an increase in pressure, i.e., in the radial stress at the cement-rock interface, if the pore pressure falls, and is globally similar to a reduction in the cement-rock pressure if the pore pressure increases.

The above study of the principal types of deterioration of the cementing sheath which can occur during the lifetime of the well has enabled a method to be developed which can be used to prepare a cement slurry which can avoid these types of deterioration in the sheath for a given well and, conversely, it has enabled a determination to be made as to whether a given cement slurry is capable of avoiding sheath deterioration for a given well.

This method uses computer programs which use the data concerning the characteristics of the borehole and the well casing, and also data on the elastic properties of the rock traversed by the well, this data being obtained by taking samples, for example. The software then estimates the variations in pressure and/or temperature in the well and/or variations in the in-situ stresses, which can occur during the lifetime of the well.

In general, variations in well pressure and/or in temperature can be calculated quite accurately, while this is not the case for variations in in-situ stresses which must be estimated on the basis of mathematical models.

The software then determines the stress conditions in the sheath resulting from the above variations which have been calculated or estimated, the type of deterioration which is likely to occur first and its risk, and the influence of the elastic properties of the sheath, of the casing and/or of the rock, in order to eliminate this risk of deterioration and as a result to select the elastic properties required for the sheath and for a given well.

What is claimed is:

1. A method of defining the properties of a cement sheath for use in positioning a casing in an oil or gas well or the like, the method comprising:

(i) estimating at least one of pressure, temperature and in-situ stresses which can occur in the well during its lifetime;

(ii) determining geometrical characteristics of the well and the casing and mechanical properties of formations surrounding the well;

(iii) for a given sheath in the well, evaluating stresses that will be applied to the sheath as a function of the estimated pressure, temperature and in-situ stresses, and the determined geometrical characteristics and mechanical properties;

(iv) determining from the evaluated stresses, the nature of the stress most likely to cause deterioration of the given sheath;

(v) evaluating the influence on the determined most likely stress of the mechanical and physical properties of the given sheath, the formations surrounding the well and the casing; and (vi) defining cement sheath properties by adjusting the given cement sheath properties, including its elastic properties, on the basis of the evaluation and determination to provide as high a ratio as possible between its tensile strength and Young's modulus and to attenuate the effect of the determined most likely stress.

2. A method as claimed in claim 1, further comprising evaluating elastic properties of the formations and defining the cement sheath properties such that the sheath has a Young's modulus which is lower than that of the formations.

3. A method as claimed in claim 1, wherein the sheath properties are defined on the basis of the application of compression to the sheath while it is being positioned around the casing.

4. A method as claimed in claim 1, wherein the step of defining sheath properties includes defining an expansion that is sufficiently low to avoid detachment of the sheath at the sheath/casing and sheath/formation interfaces.

5. A method as claimed in claim 1, further comprising the step of defining properties of the casing including its thickness so as to limit its deformation as well pressure increases.

6. A method as claimed in claim 1, comprising using data obtained from laboratory tests as inputs for at least one of the steps.

7. A method as claimed in claim 1, comprising using data obtained from numerical simulation as inputs for at least one of the steps.

8. A method of positioning a cement sheath around a casing in a well, comprising:

(i) estimating at least one of pressure, temperature and in-situ stresses which can occur in the well during its lifetime;

(ii) determining geometrical characteristics of the well and the casing and mechanical properties of formations surrounding the well;

(iii) for a given sheath in the well, evaluating stresses that will be applied to the sheath as a function of the estimated pressure, temperature and in-situ stresses, and the determined geometrical characteristics and mechanical properties;

(iv) determining from the evaluated stresses, the nature of the stress most likely to cause deterioration of the given sheath;

(v) evaluating the influence on the determined most likely stress of the mechanical and physical properties of the given sheath, the formations surrounding the well and the casing;

(vi) selecting cement sheath properties by adjusting the given cement sheath properties, including its elastic properties, on the basis of the evaluation and determination to provide as high a ratio as possible between its tensile strength and Young's modulus and to attenuate the effect of the determined most likely stress;

(vii) positioning a casing in the well; and (viii) positioning a cement sheath having the selected properties around the casing.

9. A method as claimed in claim 8, further comprising evaluating elastic properties of the formations and selecting the cement sheath properties such that the sheath has a Young's modulus which is lower than that of the formations.

10. A method as claimed in claim 8, further comprising placing the cement sheath in compression while it is being positioned around the casing.

11. A method as claimed in claim 8, wherein the sheath properties are selected to have an expansion that is sufficiently low to avoid detachment of the sheath at the sheath/casing and sheath/formation interfaces.

12. A method as claimed in claim 8, further comprising selecting a casing of increased thickness to limit its deformation as well pressure increases.

13. A method as claimed in claim 8, further comprising controlling the temperature increase in the well to attenuate the effects of temperature on the casing, prior to injecting a fluid into the formations traversed by the well to stimulate production therefrom.

* * * * *